US005810348A

United States Patent [19]

Scheufler

[11] Patent Number: 5,810,348

[45] Date of Patent: Sep. 22, 1998

[54] DELIVERY UNIT OF A COPYING APPARATUS

[75] Inventor: Gert Scheufler, Stuttgart, Germany

[73] Assignee: Eastman Kodak Company, Rochester, N.Y.

[21] Appl. No.: 703,288

[22] Filed: Aug. 26, 1996

[30] Foreign Application Priority Data

Aug. 31, 1995 [DE] Germany ..... 195 32 108.1

[51] Int. Cl.[6] ..... B65H 29/34; B65H 31/26; B65H 31/04

[52] U.S. Cl. ..... 271/213; 271/189; 271/209; 271/220; 271/258.01

[58] Field of Search ..... 271/3.04, 189, 271/209, 220, 258.01, 213, 175

[56] References Cited

U.S. PATENT DOCUMENTS

| | | | |
|---|---|---|---|
| 3,556,513 | 1/1971 | Howard | 271/3.04 |
| 4,611,800 | 9/1986 | Parsons et al. | 271/3.04 |
| 5,026,034 | 6/1991 | Russel et al. | 271/220 |
| 5,032,876 | 7/1991 | Murakami | 355/324 |
| 5,179,880 | 1/1993 | Sherick | 271/175 X |
| 5,386,982 | 2/1995 | Kawano | 271/10 |
| 5,524,877 | 6/1996 | Weber et al. | 271/220 |

FOREIGN PATENT DOCUMENTS

| | | | |
|---|---|---|---|
| 3843281 | 6/1990 | Germany | 271/220 |

*Primary Examiner*—Boris Milef
*Attorney, Agent, or Firm*—Lawrence P. Kessler

[57] ABSTRACT

A delivery unit (1) of a copying apparatus is equipped with a paper delivery tray (2), provided in a top cover (4). The paper delivery tray (2) consists of at least one inclined delivery surface (**2*a*, 2*b*) for a sheet stack, an output slot (10) formed by paper output rollers (8), and a paper contact surface (6) arranged after the output slot (10). A bar (12), which fits around the output slot (10) and can be pivoted onto the sheet stack (5) located on the delivery surface on the basis of a signal form the copying apparatus, is provided in a wall (7**) of the paper delivery tray.

5 Claims, 1 Drawing Sheet

DELIVERY UNIT OF A COPYING APPARATUS

BACKGROUND OF THE INVENTION

The invention relates to a delivery unit of a copying apparatus, with a paper delivery tray, provided in a top cover, which possesses at least on inclined delivery surface for a sheet stack, an output slot formed by paper output rollers, and a paper contact surface arranged after the output slot.

U. S. Pat. No. 5,386,982 describes a paper feed apparatus which has a bar that can be pivoted counterclockwise in order to rest on the stack of paper present in the tray. The bar touches the front end of the sheets that are stored in the tray of the paper feed apparatus. Provided on the components of the movement mechanism for the bar are sensors which indicate to the paper-processing apparatus that paper is present in the tray. Since the bar extends over the entire width of the tray, papers with different formats can be processed.

U.S. Pat. No. 5,032,876 describes a finisher. The copied and or processed sheets are delivered onto a sheet tray. A sensor is provided which determines the height of the stack, and the sheet tray is displaced vertically in accordance with the result. A lever arm, which is mounted pivotably about an axis, is provided in order to determine the height of the sheet stack. One end of the lever arm rests on the stack, while the other end is sensed by the sensor. From the lever arm position determined in this fashion, a signal is generated which moves the delivery tray accordingly.

SUMMARY OF THE INVENTION

It is the object of the invention to create a single delivery unit for a copying or printing apparatus which makes it possible, in a simple and reliable manner, to separate a sorted and previously processed sheet stack from sheets that are output after a paper jam.

It is also an object of the invention that the separation of previously process sheets from sheets that are output after a paper jam operate regardless of the paper format, paper orientation, or stack height of the sheets in the paper delivery tray.

According to the invention, this object is attained in that a bar fits around the output slot and, in its starting position, is housed in a wall of the paper delivery tray; and that the bar can be pivoted onto the sheet stack located on the delivery surface on the basis of a signal form the copying apparatus.

The advantage of the delivery unit according to the invention is that a single paper delivery tray is used to separate "finished" sheets from sheets that are delivered out of a copying or printing apparatus, after a paper jam, into the same paper delivery tray. For this purpose, in the event of a paper jam the sheet stack already present in the paper delivery tray is mechanically separated by means of a bar which swings down. In its starting position, the bar is recessed in a wall of the cover of the delivery unit. The sheets intended to be discarded then fall onto the bar, on which a sensor is located. This sensor delivers to the copying or printing apparatus the information as to whether the waste has been removed from the virtual paper delivery tray. The pivoting motion of the bar is performed by a stepping motor.

BRIEF DESCRIPTION OF THE DRAWINGS

The subject of the invention is described with reference to the embodiment described in the drawing, in which.

DESCRIPTION OF THE PREFERRED EMBODIMENT

Figure 1:
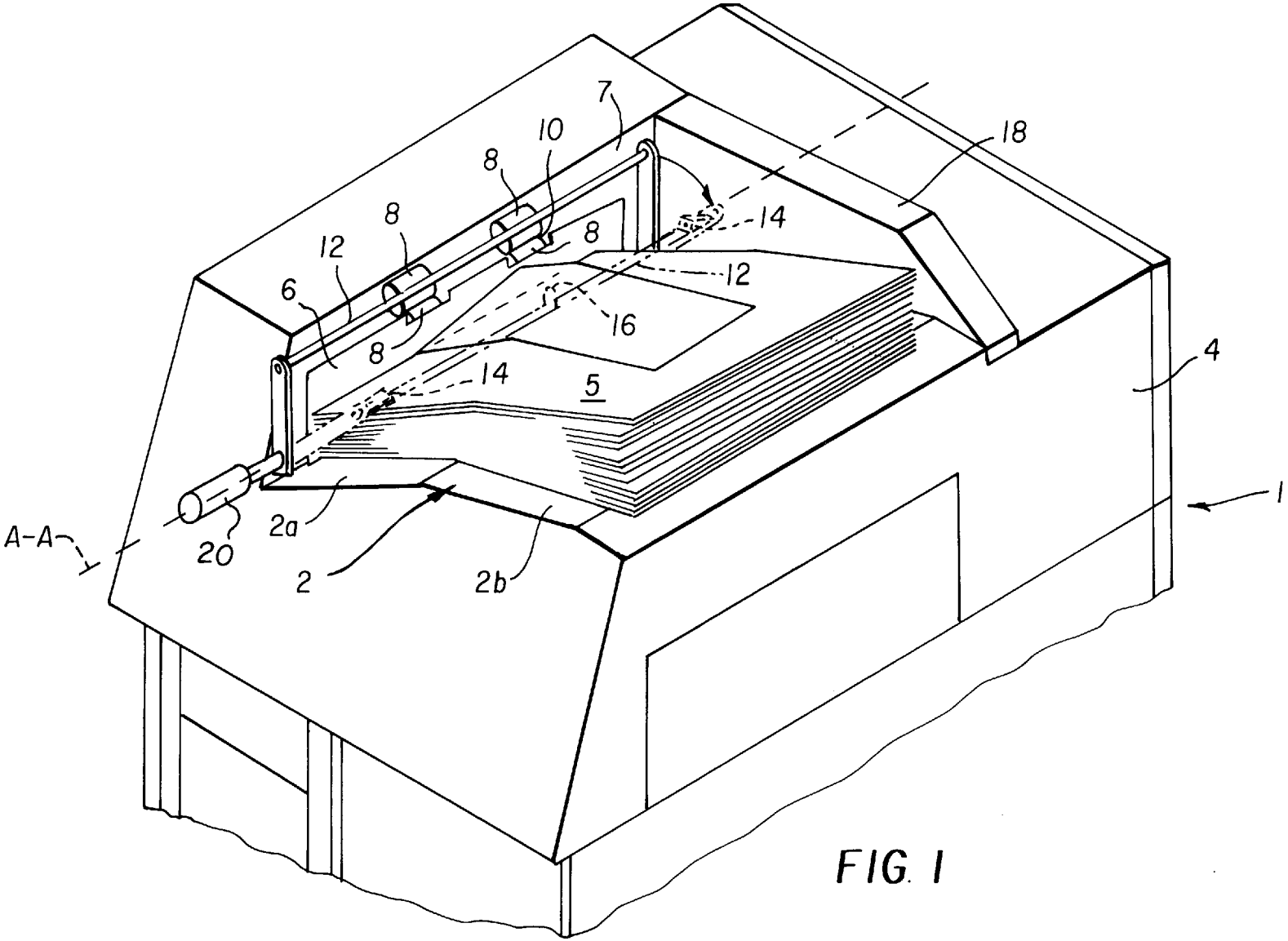
FIG. 1 shows a perspective depiction of the paper delivery tray according to the invention.

FIG. 1 shows a paper delivery tray 2 according to the invention, of a delivery unit 1 of a copying or printing apparatus. A copying or printing apparatus consists of a number of accessory units, such as staplers, hole-punchers, folding devices, collating devices, etc., which are known in the prior art. The construction of a specific copying or printing apparatus will therefore not be discussed in further detail in the description which follows.

The paper delivery tray 2 is shaped into a top cover 4 of delivery unit 1 of the copying or printing apparatus. In the embodiment shown, the paper delivery tray 2 consists of a first surface 2*a* and a second surface 2*b* that are inclined differently with respect to the horizontal plane. It is self-evident, however, that the paper delivery tray 2 can also consist of a single surface that has a constant inclination with respect to the horizontal plane. The first surface 2*a* has a greater inclination than the second surface 2*b*. In addition, the paper delivery tray 2 is delimited, in the direction of an arrangement of output rollers 8, by a wall 7. A lateral stop 18 laterally adjoins paper delivery tray 2.

A paper contact surface 6 is provided directly after the arrangement of the output rollers 8, the paper contact surface 6 delimiting the first surface 2*a* in the direction of output rollers 8. The output rollers are driven in conventional fashion and thereby form an output slot 10 for sheets or printed products that are produced with the copying or printing apparatus. Provided in wall 7 (parallel to paper contact surface 6) of paper delivery tray 2 is a bar 12 that is pivotable about an axis A—A. Bar 12 can be pivoted down by means of a stepping motor 20 onto a sheet stack 5 located in paper delivery tray 2.

In the event of a paper jam in the copying or printing apparatus, a signal is sent to the stepping motor causing it to swing bar 12 down onto the sheet stack 5 that has already been delivered to paper delivery tray 2. The sheets or printed products already processed by the copying or printing apparatus are thereby separated from those that are discharged from the copying or printing apparatus in order to eliminate a paper jam. The sheets discharged in this manner come to rest on bar 12, and are thus unequivocally separated from the "finished" sheets or printed products. A sensor 14, for example an infrared photoelectric barrier, is installed on the bar 12 in such a way that when said bar 12 is lowered onto the sheet stack 5, the sensor 14 is provided at the top of bar 12 and thus comes to rest on sheet stack 5. A projecting wire loop 16, which facilitates interruption of the sensor beam of sensor 14, is provided on the side of bar 12 carrying the sensor. For example, when the sheets still located in the copying or printing apparatus are discharged onto paper delivery tray 2 after a paper jam, they come to rest on bar 12 which has already been pivoted down. A wire loop 16 present on bar 12 causes the sheets to droop down on at least one side of said loop, thus effectively interrupting the sensor beam of sensor 14. Interruption of the sensor beam indicates to the copying or printing apparatus that the paper jam has not yet been remedied, or that sheets or printed products intended to be discarded are still present in the paper delivery tray 2. Once these sheets or printed products are removed, the sensor beam is cleared and at the same time a signal is sent to the copying or printing apparatus causing the stepping motor to pivot bar 12 back into the starting position.

The bar 12 can also be used to secure finished sheets already delivered into the paper delivery tray 2. For this purpose the bar is moved down onto the stack of "finished" sheets when the top cover 4 is opened, thus preventing the sheets already collected on paper delivery tray 2 from tipping over. This requires not only the stepping motor drive (not illustrated) for bar 12, but also a controllable safety catch (not shown) in order to produce a corresponding contact force for bar 12. The sheet stack 5 delivered into paper delivery tray 2 is prevented from tipping over or falling out by lateral stop 18 and by bar 12 pressing onto sheet stack 5.

The invention described above makes it possible, in the event of a jam, to use an existing paper delivery tray 2 simultaneously and additionally as a delivery tray for sheets that are transported out of the copying or printing apparatus after a jam. This ensures that the "finished" sheets are separated from sheets intended to be discarded.

The present invention was described with reference to a preferred embodiment, but modifications can of course be made by one skilled in the art, without leaving the scope of the claims which follow.

What is claimed is:

1. Delivery unit (1) of a copying apparatus, with a paper delivery tray (2), provided in a top cover (4), which possesses at least one inclined delivery surface **(2*a*, 2*b*) for a sheet stack, and an output slot (10)**, comprising:

a bar (12) around the output slot (10); said bar being mounted to the top cover for pivotable movement to a starting position housed in a wall (7) of the paper delivery tray (2) and to a pivoted position down on the sheet stack;

a sensor (14) provided on said bar (12), which when said bar (12) is pivoted down onto the sheet stack (5), said sensor (14) is mounted on the side of said bar (12) which faces away form the sheet stack (5); and means for pivoting said bar wherein said bar (12) is pivoted onto the sheet stack (5) located on the delivery surface **(2*a*, 2*b*)** on the basis of a signal from the copying apparatus.

2. Delivery unit (1) according to claim 1, characterized in that said signal from the copying apparatus indicates a paper jam.

3. Delivery unit (1) according to claim 1, characterized in that said signal from the copying apparatus indicates that the top cover (4) of the delivery unit (1) is open.

4. Delivery unit (1) according to claim 1, characterized in that said sensor (14) is an infrared photoelectric barrier.

5. Delivery unit (1) according to claim 1, characterized in that on the side of said bar (12) which carries said sensor (14), there is also provided a projecting wire loop (16), centered with respect to the lengthwise extension of said bar (12) in such a way that sheets laid on said bar droop laterally toward said sensor (14).

* * * * *